US007600520B2

(12) United States Patent
Choi

(10) Patent No.: US 7,600,520 B2
(45) Date of Patent: Oct. 13, 2009

(54) PORTABLE ELECTRIC CURLING IRON

(75) Inventor: Young Man Choi, 745-72 Guro-4-dong, Guro-gu, Seoul 152-972 (KR)

(73) Assignees: Young Man Choi, Seoul (KR); Chang Kil Yang, Gyeonggi-do (KR)

( * ) Notice: Subject to any disclaimer, the term of this patent is extended or adjusted under 35 U.S.C. 154(b) by 189 days.

(21) Appl. No.: 11/547,991

(22) PCT Filed: Jan. 27, 2005

(86) PCT No.: PCT/KR2005/000239

§ 371 (c)(1),
(2), (4) Date: Oct. 6, 2006

(87) PCT Pub. No.: WO2005/096872

PCT Pub. Date: Oct. 20, 2005

(65) Prior Publication Data

US 2007/0209673 A1 Sep. 13, 2007

(30) Foreign Application Priority Data

Apr. 9, 2004 (KR) ..... 20-2004-0009794

(51) Int. Cl.
*A45D 1/00* (2006.01)

(52) U.S. Cl. ..... 132/224

(58) Field of Classification Search ..... 132/223–227, 132/229–231; 219/225
See application file for complete search history.

(56) References Cited

U.S. PATENT DOCUMENTS 4,101,757 A * 7/1978 Van Dyck et al. ..... 219/225
4,215,264 A * 7/1980 Hetherington ..... 219/225
5,223,694 A * 6/1993 Tsuji et al. ..... 219/225
D411,333 S 6/1999 Smal
6,173,718 B1 1/2001 Okumoto et al.

FOREIGN PATENT DOCUMENTS

JP 2002-253329 9/2002
KR 255137 12/2001

OTHER PUBLICATIONS

International Search Report dated May 27, 2005.

* cited by examiner

*Primary Examiner*—Robyn Doan
*Assistant Examiner*—Rachel R Steitz
(74) *Attorney, Agent, or Firm*—Knobbe Martens Olson & Bear LLP

(57) ABSTRACT

A portable electric curling iron comprises an upper movable iron body (20) and a lower movable iron body (40), which are connected to an upper stationary iron body (10) and a lower stationary iron body (30), respectively, such that the upper and lower movable iron bodies (20, 40) can be selectively retracted into an extended from the upper and lower stationary iron bodies (10, 30) through openings (11, 31) respectively. The upper and lower movable iron bodies (20, 40) are provided with guide grooves (22, 42), in which guide protrutions (12, 32) formed at the upper and lower stationary iron bodies (10, 30) are engaged, respectively, such that the guide protrutions (12, 32) can be guided along the corresponding guide grooves (22, 42). Heating members (50) are attached to the upper and lower movable iron bodies (20, 40), respectively, while being opposite to each other.

9 Claims, 5 Drawing Sheets

PRIOR ART

PORTABLE ELECTRIC CURLING IRON

TECHNICAL FIELD

The present invention relates to a portable electric curling iron, and, more particularly, to a portable electric curling iron having heating members that are retracted into and extended from an iron body of the electric curling iron, whereby portability of the electric curling iron is improved.

BACKGROUND ART

Generally, individual unique hairstyles play an important part in appearance or first impressions.

This is particularly important to women, who curl their hair in various different hairstyles according to their dresses and accessories or surroundings and circumstances to represent their unique personalities and senses of beauty. For this reason, women frequently change their hairstyles.

Correspondingly, electric curling irons, constructed for women to curl their hair in various different hairstyles without time and spatial limits, have been increasingly used.

FIG. 1 is a perspective view illustrating a conventional electric curling iron. As shown in FIG. 1, the conventional electric curling iron has an iron body comprising an upper iron body 10 and a lower iron body 30. The upper iron body 10 and the lower iron body 30 are hingedly connected to each other via a hinge part 60 having a predetermined resilient force such that the upper iron body 10 and the lower iron body 30 are arranged in the shape of pliers. To the inner surface of the upper iron body 10 is attached a heating member 50, and to the inner surface of the lower iron body 30 is also attached another heating member 50, which corresponds to the heating member 50 of the upper iron body 10. The heating members 50 are connected to printed circuit boards (not shown), which are operated when the printed circuit boards are supplied with external electric current through a power connection part 70, thus being heated to a predetermined temperature. Hair is put between heating members 50, and then the upper iron body 10 and the lower iron body 30 are moved toward each other. In this way, the hair can be arranged into various different hairstyles.

In the conventional electric curling iron with the above-stated construction, however, the upper and lower iron bodies of the electric curling iron each have a fixed length, which increases the overall size of the electric curling iron, and therefore, portability of the electric curling iron is very low.

SUMMARY OF CERTAIN INVENTIVE ASPECTS

One aspect of the present invention provides a portable electric curling iron having heating members that are retracted into and extended from an iron body of the electric curling ion, whereby the size of the portable electric curling iron is reduced, and therefore, the portable electric curling iron is stowed or carried with ease and convenience.

Another aspect of the present invention provides a portable electric curling iron having switch parts that are capable of automatically turning the heating members off or on simultaneously with the retraction or extension of the heating members into or from the iron body, whereby the convenience of the portable electric curling iron is maximized.

Another aspect of the present invention provides a portable electric curling iron comprising an upper stationary iron body and a lower stationary iron body, the upper stationary iron body and the lower stationary iron body being hingedly connected to each other via a hinge part having a predetermined resilient force such that the upper stationary iron body and the lower stationary iron body are arranged in the shape of pliers, the upper and lower stationary iron bodies having heating members attached thereto, respectively, for converting external electric current supplied to the heating members into thermal energy and emitting the converted thermal energy, the heating member of the upper stationary iron body corresponding to the heating member of the lower stationary iron body, wherein the upper stationary iron body and the lower stationary iron body have predetermined spaces defined therein, respectively, the upper stationary iron body and the lower stationary iron body are provided at the front ends thereof with openings, respectively, the upper stationary iron body and the lower stationary iron body are provided at the inner surface of at least one side part of the upper stationary iron body and at the inner surface of at least one side part of the lower stationary iron body, adjacent to the openings with guide protrusions, respectively, and the portable electric curling iron further comprises an upper movable iron body and a lower movable iron body connected to the upper stationary iron body and the lower stationary iron body, respectively, such that the upper movable iron body and the lower movable iron body can be selectively retracted into and extended from the spaces of the upper stationary iron body and the lower stationary iron body through the openings, respectively, the upper movable iron body and the lower movable iron body being provided at the outer surface of at least one side part of the upper movable iron body and at the outer surface of at least one side part of the lower movable iron body with guide grooves, respectively, such that the guide protrusions are guided along the guide grooves while being engaged in the guide grooves, respectively, the heating members being attached to the upper movable iron body and the lower movable iron body, respectively, while being opposite to each other.

In one embodiment, the upper stationary iron body and the lower stationary iron body are provided at at least one side part of the upper stationary iron body and at at least one side part of the lower stationary iron body with stoppers for maintaining the extended state of the upper movable iron body and the lower movable iron body after the upper movable iron body and the lower movable iron body are extended from the upper stationary iron body and the lower stationary iron body, respectively, each of the stoppers comprising: a hinge having a predetermined resilient force, a latching protrusion formed at one side of the hinge for locking the rear end of the upper movable iron body/the lower movable iron body extended from the upper stationary iron body/the lower stationary iron body and a press part formed at the other side of the hinge such that the press part is pressed by an external force applied to the press part for releasing the locked state of the rear end of the upper movable iron body/the lower movable iron body.

In one embodiment, the upper stationary iron body and the lower stationary iron body are provided at the upper position of the space of the upper stationary iron body and at the lower position of the space of the lower stationary iron body with cable location parts for allowing power cables to be located therein, respectively, the upper stationary iron body and the lower stationary iron body are provided at the inner top surface of the upper stationary iron body and at the inner bottom surface of the lower stationary iron body, adjacent to the front ends of the cable location parts, with switch parts, respectively, the switch parts having pairs of insertion holes, respectively, the switch parts being connected to terminals of the power cables such that electric current can be supplied to the switch parts, respectively, and the upper movable iron body and the lower movable iron body are provided at the upper surface of the upper movable iron body and the lower surface of the lower movable iron body, adjacent to the rear ends of the upper movable iron body and the lower movable iron body with contact members having a predetermined resilient force, respectively, such that the contact members can be inserted into the insertion holes of the switch parts when the upper movable iron body and the lower movable iron body are extended from the upper stationary iron body and the lower stationary iron body, respectively, and therefore, the contact members come into electrical contact with the switch parts, respectively, to operate the heating members.

In one embodiment, the portable electric curling iron further comprises: a holding member for holding the front ends of the upper stationary iron body and the lower stationary iron body while the upper movable iron body and the lower movable iron body are retracted in the space of the upper stationary iron body and the lower stationary iron body, respectively, such that the upper stationary iron body and the lower stationary iron body are in tight contact with each other.

According to one embodiment of the present invention with the above-stated construction, the upper and lower movable iron bodies, to which the heating members are attached, are retracted into the upper and lower stationary iron bodies, respectively, whereby the portability of the portable electric curling iron is improved. Furthermore, a user can easily extend the upper and lower movable iron bodies, to which the heating members are attached, from the upper and lower stationary iron bodies, respectively, when the user wishes to use the electric curling iron, whereby the convenience of the portable electric curling iron is improved.

BRIEF DESCRIPTION OF DRAWINGS

Embodiments of the present invention will be more clearly understood from the following detailed description taken in conjunction with the accompanying drawings.

DETAILED DESCRIPTION OF CERTAIN INVENTIVE EMBODIMENTS

Now, embodiments of the present invention will be described in detail with reference to the accompanying drawings.

Figure 1:
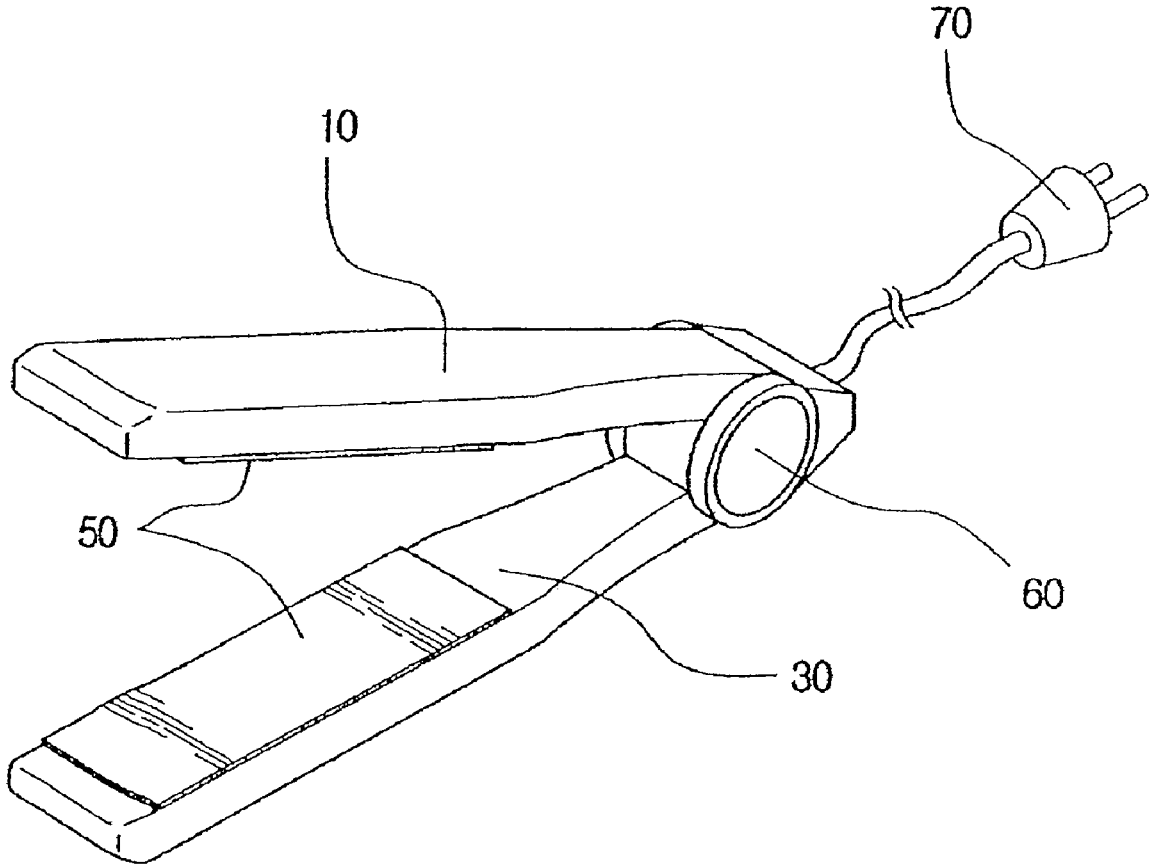
FIG. 1 is a perspective view illustrating a conventional electric curling iron.
Figure 2:
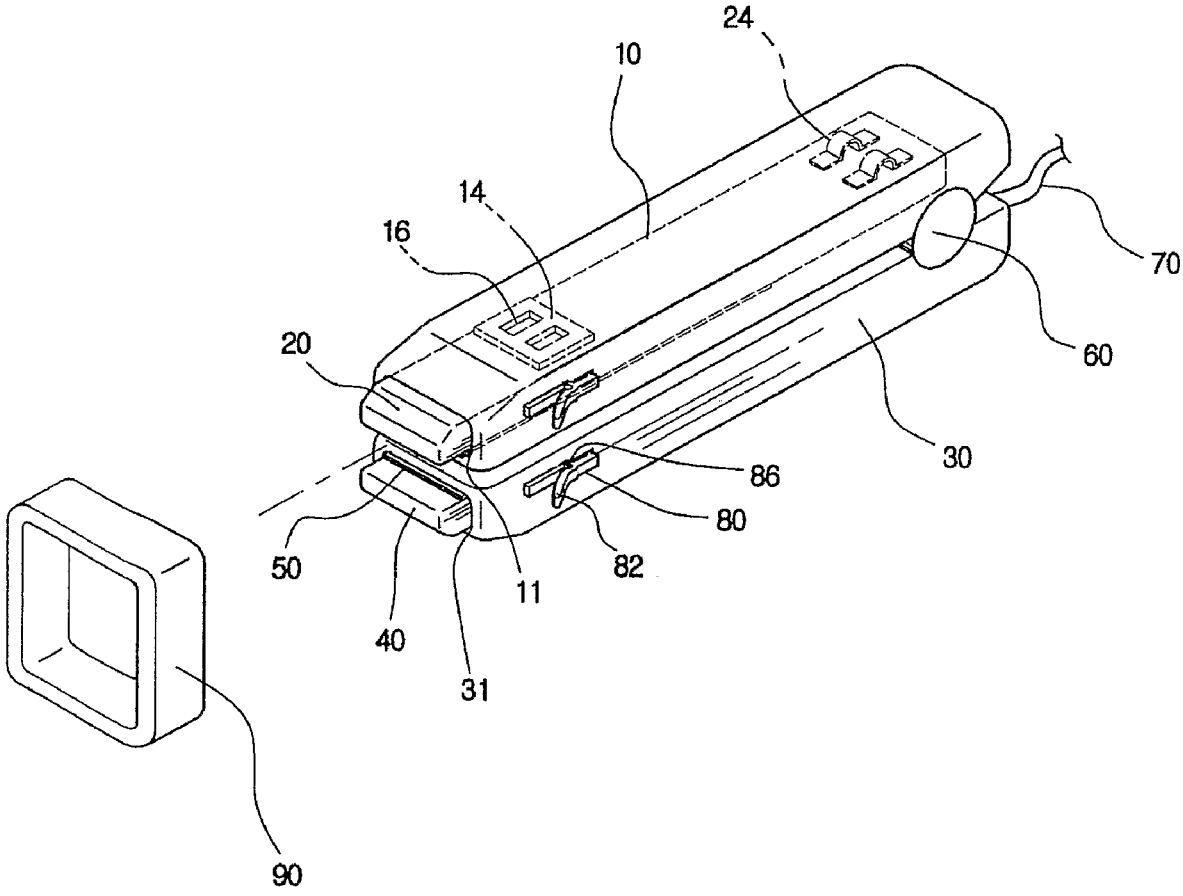
FIG. 2 is a perspective view illustrating a portable electric curling iron according to one embodiment of the present invention.
Figure 3:
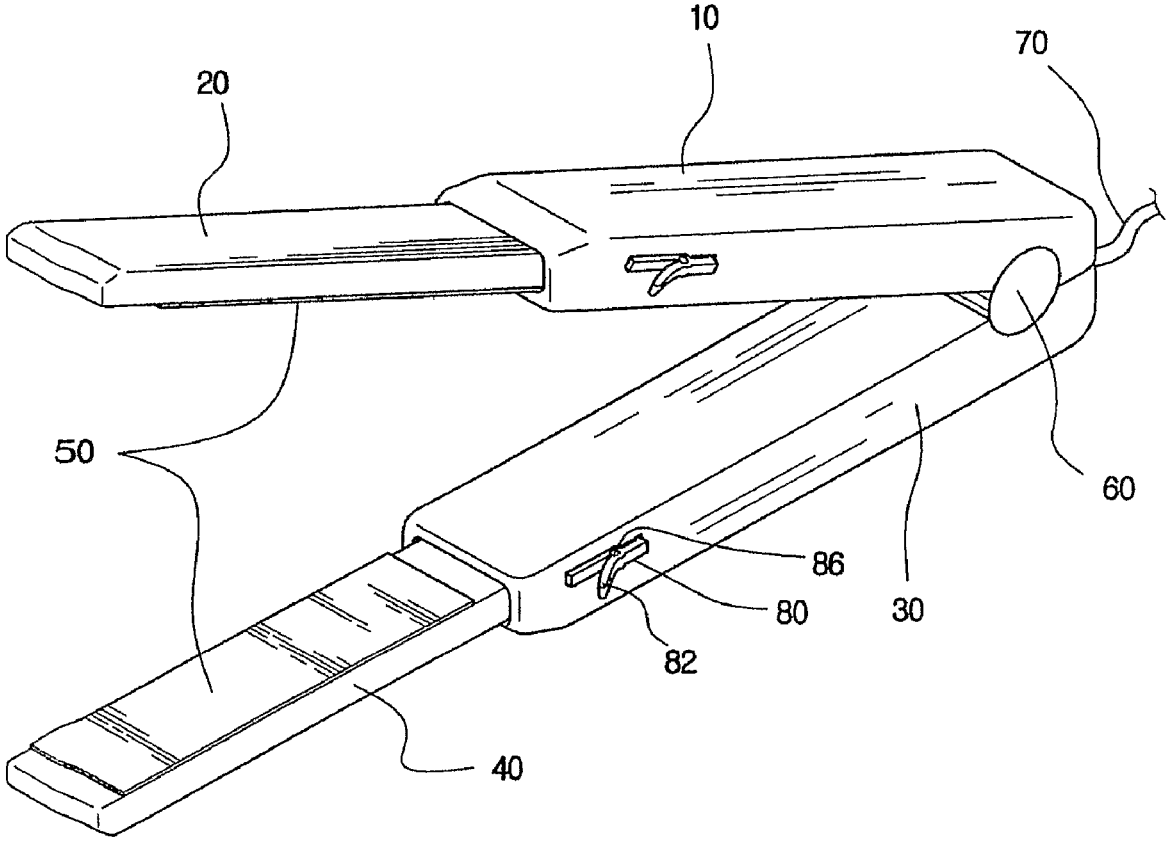
FIG. 3 is a perspective view illustrating how the portable electric curling iron according to one embodiment of the present invention is used.
Figure 4A:
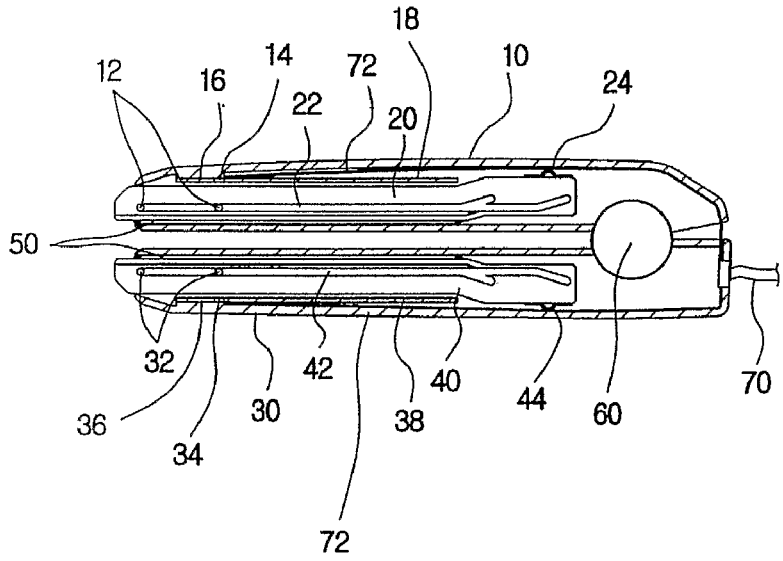
FIGS. 4A and 4B are side views, in section, illustrating heating members of the portable electric curling iron according to one embodiment of the present invention in retracted and extended states, respectively.
Figure 4B:
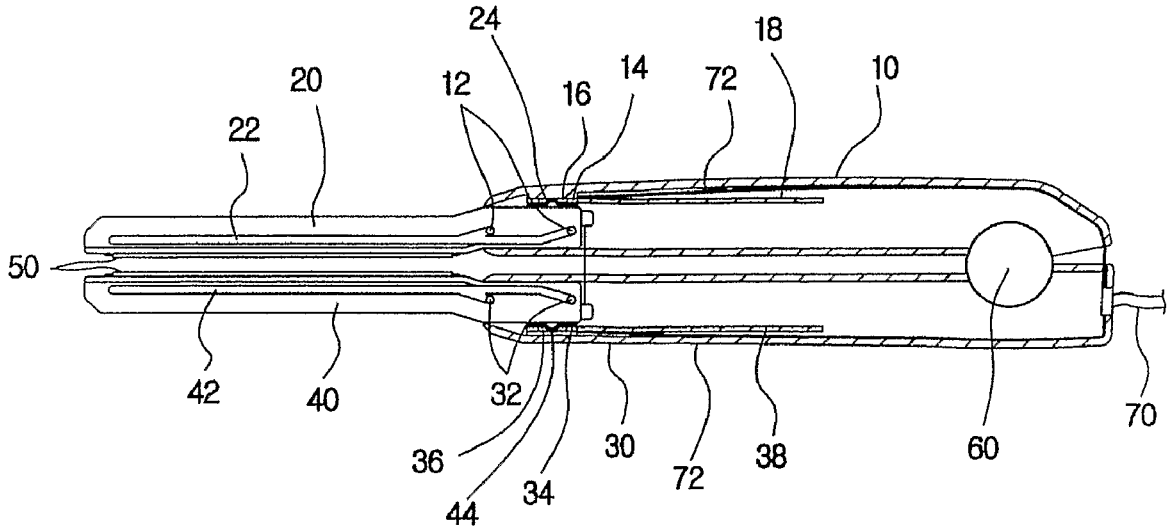
Figure 5A:
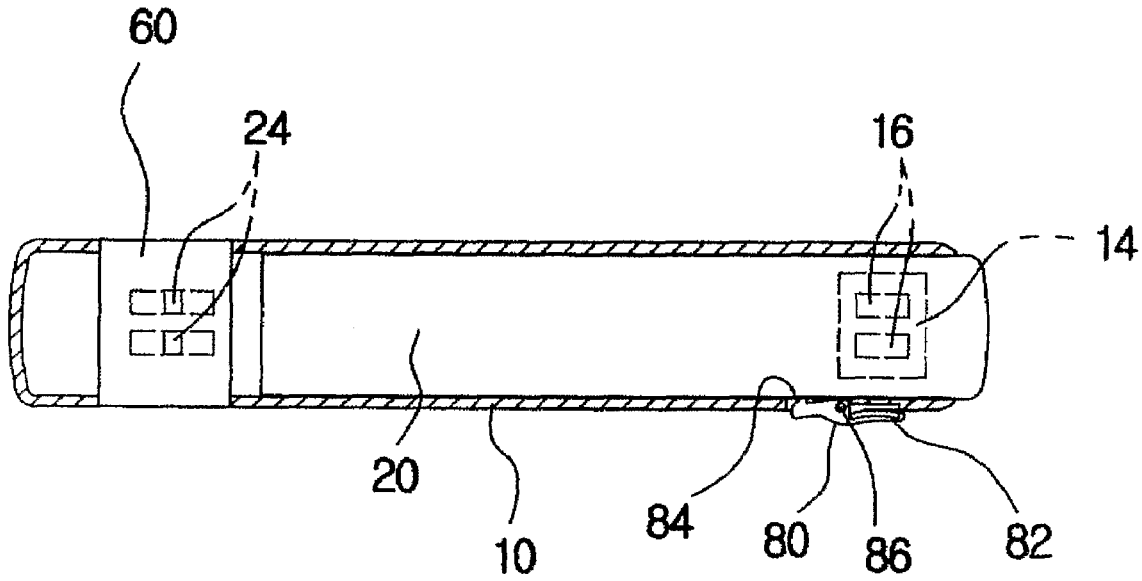
FIGS. 5A and 5B are plan views, in section, illustrating the heating members of the portable electric curling iron according to one embodiment of the present invention in the retracted and extended states, respectively.
Figure 5B:
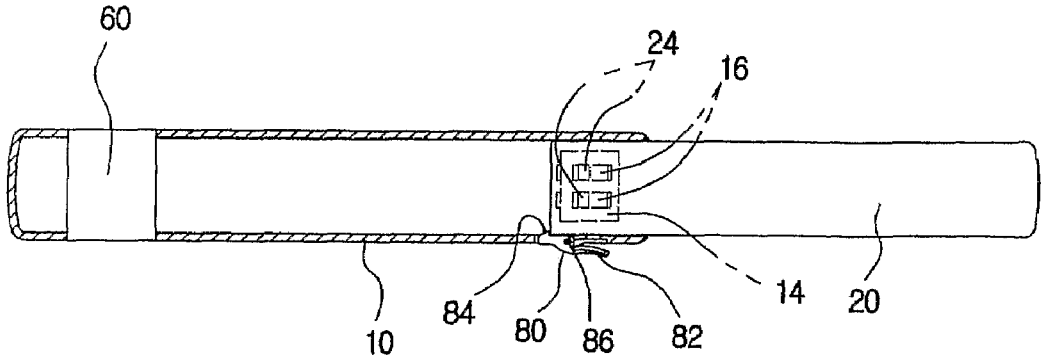

As shown in FIGS. 2 to 5B, the portable electric curling iron comprises: an upper stationary iron body 10 formed in the shape of a bar having a predetermined length; and a lower stationary iron body 30 formed in the shape of a bar having the same length as the upper stationary iron body 10. The upper stationary iron body 10 and the lower stationary iron body 30 are hingedly connected to each other via a hinge part 60 having a predetermined resilient force such that the upper stationary iron body 10 and the lower stationary iron body 30 are arranged in the shape of pliers.

The portable electric curling iron further comprises: an upper movable iron body 20 connected to the upper stationary iron body 10 such that the upper movable iron body 20 can be retracted into and extended from the upper stationary iron body 10; and a lower movable iron body 40 connected to the lower stationary iron body 30 such that the lower movable iron body 40 can be retracted into and extended from the lower stationary iron body 30. To the upper movable iron body 20 is attached a heating member 50, and to the lower movable iron body 40 is attached another heating member 50, which corresponds to the heating member 50 attached to the upper movable iron body 20.

To this end, the upper stationary iron body 10 and the lower stationary iron body 30 have predetermined spaces defined therein, respectively. Also, the upper stationary iron body 10 and the lower stationary iron body 30 are provided at the front ends thereof with openings 11 and 31 for allowing the upper movable iron body 20 and the lower movable iron body 40 to be retracted into and extended from the upper stationary iron body 10 and the lower stationary iron body 30 therethrough, respectively. A pair of guide protrusions 12 is formed at the inner surface of one of both side parts of the upper stationary iron body 10 adjacent to the opening 11. Preferably, two pairs of guide protrusions 12 may be formed at the inner surfaces of both side parts of the upper stationary iron body 10, respectively. Similarly, a pair of guide protrusions 32 is formed at the inner surface of one of both side parts of the lower stationary iron body 30 adjacent to the opening 31. Preferably, two pairs of guide protrusions 32 may be formed at the inner surfaces of both side parts of the lower stationary iron body 10, respectively.

At the outer surface of one of both side parts of the upper movable iron body 20, to which the heating member 50 is attached, is formed a guide groove 22, which extends longitudinally along the length of the upper movable iron body 20 such that the guide protrusions 12 are guided along the guide groove 22 while being engaged in the guide groove 22. Preferably, two guide grooves 22 may be formed at the outer surfaces of both side parts of the upper movable iron body 20, to which the heating member 50 is attached, such that the guide protrusions 12 are guided along the guide grooves 22 while being engaged in the guide grooves 22, respectively. Similarly, a guide groove 42 is formed at the outer surface of one of both side parts of the lower movable iron body 40 while extending longitudinally along the length of the lower movable iron body 40 such that the guide protrusions 32 are guided along the guide groove 42 while being engaged in the guide groove 42. Preferably, two guide grooves 42 may be formed at the outer surfaces of both side parts of the lower movable iron body 40, to which the heating member 50 is attached, such that the guide protrusions 32 are guided along the guide grooves 42 while being engaged in the guide grooves 42, respectively. Consequently, the upper movable iron body 20 and the lower movable iron body 40 can be retracted into or extended from the upper stationary iron body 10 and the lower stationary iron body 30 through the guidance of the guide protrusions 12 and 32 along the guide grooves 22 and 42, respectively.

At one of both side parts of the upper stationary iron body 10 is disposed a stopper 80 for maintaining the extended state of the upper movable iron body 20 after the upper movable iron body 20 is extended from the upper stationary iron body 10. Similarly, another stopper 80 is disposed at one of both side parts of the lower stationary iron body 30 for maintaining the extended state of the lower movable iron body 40 after the lower movable iron body 40 is extended from the lower stationary iron body 30. Each of the stoppers 80 comprises: a hinge 86 having a predetermined resilient force; a latching protrusion 84 formed at one side of the hinge 86 for locking the rear end of the upper movable iron body 20 extended from the upper stationary iron body 10 or the rear end of the lower movable iron body 40 extended from the lower stationary iron body 30; and a press part 82 formed at the other side of the hinge 86 such that the press part 82 is pressed by an external force applied to the press part 82 for releasing the locked state of the rear end of the upper movable iron body 20 or the rear end of the lower movable iron body 40.

The portable electric curling iron according to one embodiment of the present invention further comprises: a switch unit that is capable of automatically turning the heating members 50 off or on simultaneously with the retraction or extension of the upper movable iron body 20 and the lower movable iron body 40 into or from the upper stationary iron body 10 and the lower stationary iron body 30, respectively.

To this end, cable location parts 18 and 38, where power cables 72 are located, are disposed at the upper and lower positions of the spaces of the upper stationary iron body 10 and the lower stationary iron body 30, respectively. Specifically, the power cables 72, which are connected to the power connection part 70 such that external electric current is supplied to the power cables 72 through the power connection part 70, are located in the cable location parts 18 and 38, respectively. At the inner top surface of the upper stationary iron body 10 and the inner bottom surface of the lower stationary iron body 30, adjacent to the front ends of the cable location parts 18 and 38, are disposed switch parts 14 and 34, respectively. The switch parts 14 and 34 have pairs of insertion holes 16 and 36, respectively. The switch parts 14 and 34 are connected to terminals of the power cables 72 such that electric current can be supplied to the switch parts 14 and 34, respectively. Preferably, the switch parts 14 and 34 are made of electrically conductive materials.

Correspondingly, contact members 24 and 44 are formed at the upper surface of the upper movable iron body 20 and the lower surface of the lower movable iron body 40, adjacent to the rear ends of the upper movable iron body 20 and the lower movable iron body 40, respectively, such that the contact members 24 and 44 can be inserted into the insertion holes 16 and 36 of the switch parts 14 and 34 when the upper movable iron body 20 and the lower movable iron body 40 are extended from the upper stationary iron body 10 and the lower stationary iron body 30, respectively. Preferably, the contact members 24 and 44 are made of electrically conductive materials, and have a predetermined resilient force. Consequently, when the upper movable iron body 20 and the lower movable iron body 40 are extended from the upper stationary iron body 10 and the lower stationary iron body 30, the contact members 24 and 44 are inserted into the insertion holes 16 and 36 of the switch parts 14 and 34, respectively. As a result, the contact members 24 and 44 come into electrical contact with the switch parts 14 and 34, respectively, and therefore, electric current is supplied to the contact members 24 and 44 through the power cables 72 and the switch parts 14 and 34 from the power connection part 70. As the contact members 24 and 44 are supplied with the electric current, printed circuit boards (not shown) are operated to supply electric current to the heating members 50, respectively.

The portable electric curling iron according to one embodiment of the present invention further comprises: a holding member 90 for holding the upper stationary iron body 10 and the lower stationary iron body 30 such that the portable electric curling iron can be easily carried. Specifically, the holding member 90 is formed in the shape of a square frame having open front and/or rear parts. While the upper movable iron body 20 and the lower movable iron body 40 are retracted in the spaces of the upper stationary iron body 10 and the lower stationary iron body 30, respectively, the upper stationary iron body 10 and the lower stationary iron body 30 are moved toward each other until the upper stationary iron body 10 and the lower stationary iron body 30 come into tight contact with each other, and then the holding member 90 is fitted on the front ends of the upper stationary iron body 10 and the lower stationary iron body 30. In this way, the upper stationary iron body 10 and the lower stationary iron body 30 are held by the holding member 90.

The operation of the portable electric curling iron with the above-stated construction according to one embodiment of the present invention will now be described in detail with reference to the accompanying drawings.

When a user wishes to use the portable electric curling iron, the user removes the holding member 90 from the front ends of the upper stationary iron body 10 and the lower stationary iron body 30. As a result, the upper stationary iron body 10 and the lower stationary iron body 30 are moved from the hinge part 60 by predetermined degrees due to a resilient restoring force of a resilient member (not shown) mounted in the hinge part 60 such that the angular distance between the upper stationary iron body 10 and the lower stationary iron body 30 increases, and therefore, the upper iron body 10 and the lower iron body 30 are arranged in the shape of pliers.

When the user connects the power connection part 70 to an outlet such that external electric current is supplied to the electric curling iron, the electric current flows to the switch parts 14 and 34 disposed in the upper stationary iron body 10 and the lower stationary iron body 30 through the power cables 72, respectively.

When the user pulls the upper movable iron body 20 and the lower movable iron body 40 retracted in the spaces of the upper stationary iron body 10 and the lower stationary iron body 30, respectively, while holding the front ends of the upper movable iron body 20 and the lower movable iron body 40, the upper movable iron body 20 and the lower movable iron body 40 are extended from the upper stationary iron body 10 and the lower stationary iron body 30, respectively, through the guidance of the guide protrusions 12 and 32, which are formed at the inner surfaces of the side parts of the upper and lower stationary iron bodies 10 and 30, respectively, along the guide grooves 22 and 42, which are formed at the outer surfaces of the side parts of the upper and lower movable iron bodies 20 and 40, respectively. When the upper movable iron body 20 and the lower movable iron body 40 are fully extended from the upper stationary iron body 10 and the lower stationary iron body 30, respectively, the rear ends of the upper movable iron body 20 and the lower movable iron body 40 are latched by the latching protrusions 84 of the stoppers 80 disposed at the side parts of the upper and lower stationary iron body 10, respectively. As a result, the extended states of the upper movable iron body 20 and the lower movable iron body 40 are maintained.

When the upper movable iron body 20 and the lower movable iron body 40 are fully extended from the upper stationary iron body 10 and the lower stationary iron body 30, respectively, the contact members 24 and 44 having the predetermined resilient force, which are formed at the upper surface of the upper movable iron body 20 and the lower surface of the lower movable iron body 40, adjacent to the rear ends of the upper movable iron body 20 and the lower movable iron body 40, respectively, are inserted into the insertion holes 16 and 36 formed at the switch parts 14 and 34 of the upper and lower stationary iron bodies 10 and 30, respectively. As a result, the contact members 24 and 44 come into electrical contact with the switch parts 14 and 34, respectively, and therefore, electric current is supplied to the contact members 24 and 44 through the power cables 72 and the switch parts 14 and 34 from the power connection part 70. As the contact members 24 and 44 are supplied with the electric current, printed circuit boards (not shown) disposed in the upper movable iron body 20 and the lower surface of the lower movable iron body 40 are operated to supply the electric current to the heating members 50, respectively. Consequently, heat is generated from the heating members 50. In this way, the user curls his/her hair in various different hairstyles using the heating members 50, which are attached to the inner surfaces of the upper and lower movable iron bodies 20 and 40.

When the user finishes using the portable electric curling iron according to one embodiment of the present invention, on the other hand, he/she presses the press parts 82, each of which is formed at one side of each hinge 86, of the stoppers 80 disposed at the upper and lower stationary iron bodies 10 and 30, respectively. As a result, the latching protrusions 84, each of which is formed at the other side of each hinge 86, are hinged about the hinges 86 such that the latching protrusions 84 are moved outward, and therefore, the locked state of the rear ends of the upper movable iron body 20 and the rear end of the lower movable iron body 40 is released. After that, the user pushes the upper movable iron body 20 and the lower movable iron body 40 such that the upper movable iron body 20 and the lower movable iron body 40 are retracted into the spaces of the upper stationary iron body 10 and the lower stationary iron body 30, respectively. As a result, the size of the portable electric curling iron is minimized. While the upper movable iron body 20 and the lower movable iron body 40 are retracted in the spaces of the upper stationary iron body 10 and the lower stationary iron body 30, respectively, the user moves the upper stationary iron body 10 and the lower stationary iron body 30 toward each other until the upper stationary iron body 10 and the lower stationary iron body 30 come into contact with each other, and then fits the holding member 90 onto the front ends of the upper stationary iron body 10 and the lower stationary iron body 30. In this way, the upper stationary iron body 10 and the lower stationary iron body 30 are held by the holding member 90 such that the portable electric curling iron can be carried with ease and convenience.

At this time, the heating members 50, which were heated to the predetermined temperature while the portable electric curling iron was used, are accommodated in the upper stationary iron body 10 and the lower stationary iron body 30, respectively. Consequently, it is possible to stow or carry the portable electric curling iron immediately after the portable electric curling iron is used without waiting for the heat of the heating members 50 to dissipate.

INDUSTRIAL APPLICABILITY

As apparent from the above description, the heating members, which are attached to the upper and lower movable iron bodies of the portable electric curling iron, respectively, are selectively retracted into and extended from the upper stationary iron body and the lower stationary iron body, respectively. Consequently, at least one embodiment of the present invention has the effect of minimizing the size of the electric curling iron, and therefore, enabling the electric curling iron to be conveniently carried or stowed after use.

Also, the heating members, which were heated to the predetermined temperature while the portable electric curling iron was used, are accommodated in the upper stationary iron body and the lower stationary iron body, respectively. Consequently, the present invention has the effect of enabling the portable electric curling iron to be stowed or carried immediately after use without waiting for the heat of the heating members to dissipate.

Furthermore, the heating members are automatically turned off or on by the switch parts of the portable electric curling iron simultaneously with the retraction or extension of the heating members into or from the upper stationary iron body and the lower stationary iron body, respectively. Consequently, at least one embodiment of the present invention has the effect of considerably improving the convenience of the portable electric curling iron, and therefore, maximizing a user's feeling of satisfaction.

Although embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A portable electric curling iron comprising an upper stationary iron body and a lower stationary iron body, the upper stationary iron body and the lower stationary iron body being hingedly connected to each other via a hinge part having a predetermined resilient force such that the upper stationary iron body and the lower stationary iron body are arranged in the shape of pliers, the upper and lower stationary iron bodies having heating members attached thereto, respectively, for converting external electric current supplied to the heating members into thermal energy and emitting the converted thermal energy, the heating member of the upper stationary iron body corresponding to the heating member of the lower stationary iron body, wherein the upper stationary iron body and the lower stationary iron body have predetermined spaces defined therein, respectively, the upper stationary iron body and the lower stationary iron body are provided at front ends thereof with openings, respectively, the upper stationary iron body and the lower stationary iron body are provided at an inner surface of at least one side part of the upper stationary iron body and at an inner surface of at least one side part of the lower stationary iron body adjacent to the openings with guide protrusions, respectively, and the portable electric curling iron further comprises an upper movable iron body and a lower movable iron body connected to the upper stationary iron body and the lower stationary iron body, respectively, such that the upper movable iron body and the lower movable iron body can be selectively retracted into and extended from the spaces of the upper stationary iron body and the lower stationary iron body through the openings, respectively, the upper movable iron body and the lower movable iron body being provided at an outer surface of at least one side part of the upper movable iron body and at an outer surface of at least one side part of the lower movable iron body with guide grooves, respectively, such that the guide protrusions are guided along the guide grooves while being engaged in the guide grooves, respectively, the heating members being attached to the upper movable iron body and the lower movable iron body, respectively, while being opposite to each other, the upper stationary iron body and the lower stationary iron body are provided at an upper position of the space of the upper stationary iron body and at a lower position of the space of the lower stationary iron body with cable location parts for allowing power cables to be located therein, respectively, the upper stationary iron body and the lower stationary iron body are provided at an inner top surface of the upper stationary iron body and at an inner bottom surface of the lower stationary iron body, adjacent to front ends of the cable location parts, with switch parts, respectively, the switch parts having pairs of insertion holes, respectively, the switch parts being connected to terminals of the power cables such that electric current can be supplied to the switch parts, respectively, and the upper movable iron body and the lower movable iron body are provided at an upper surface of the upper movable iron body and a lower surface of the lower movable iron body, adjacent to rear ends of the upper movable iron body and the lower movable iron body with contact members having a predetermined resilient force, respectively, such that the contact members are inserted into the insertion holes of the switch parts when the upper movable iron body and the lower movable iron body are extended from the upper stationary iron body and the lower stationary iron body, respectively, and therefore, the contact members come into electrical contact with the switch parts to complete electrical connections with the power cables, respectively, to provide electric power to the heating members to operate the heating members.

2. The curling iron as set forth in claim 1, wherein the upper stationary iron body and the lower stationary iron body are provided with at least one side part of the upper stationary iron body and at least one side part of the lower stationary iron body with stoppers for maintaining an extended state of the upper movable iron body and the lower movable iron body after the upper movable iron body and the lower movable iron body are extended from the upper stationary iron body and the lower stationary iron body, respectively, each of the stoppers comprising:

a hinge having a predetermined resilient force;

a latching protrusion formed at a first side of the hinge for locking a rear end of the upper movable iron body/the lower movable iron body extended from the upper stationary iron body/the lower stationary iron body; and a press part formed at a second side, opposite to the first side, of the hinge such that the press part is pressed by an external force applied to the press part for releasing the locked state of the rear end of the upper movable iron body/the lower movable iron body.

3. The curling iron as set forth in claim 1, further comprising:

a holding member for holding front ends of the upper stationary iron body and the lower stationary iron body while the upper movable iron body and the lower movable iron body are retracted in the spaces of the upper stationary iron body and the lower stationary iron body, respectively, such that the upper stationary iron body and the lower stationary iron body are in tight contact with each other.

4. The curling iron of claim 1, further comprising:

the upper stationary iron body comprising a cavity where the upper movable iron body can be retracted therein and extended therefrom, wherein the upper movable iron body can be locked extended from the upper stationary iron body by a first locking switch;

the lower stationary iron body comprising a cavity where the lower movable iron body can be retracted therein and extended therefrom, wherein the lower movable iron body can be locked extended from the lower stationary iron body by a second locking switch;

the upper moveable iron body comprising a heating member, wherein the heating member is configured to provide heat when locked extended from the upper stationary iron body by a first locking switch;

the lower moveable iron body comprising the heating member, wherein the heating member is configured to provide heat when locked extended from the lower stationary iron body by a second locking switch;

the hinge part in connection with the upper stationary iron body and the lower stationary iron body and configured to allow the upper stationary iron body and the lower stationary iron body to pivot about the hinge part, wherein the hinge part provides a force to retain the upper stationary iron body and the lower stationary iron body at a predetermined angle with substantially no external force applied on the curling iron;

the power cable in connection with the upper stationary iron body and the lower stationary iron body and configured to transfer electric current from a power source; and a holding member comprising a sleeve and configured to restrict pivoting of the upper stationary iron body and the lower stationary iron body when the upper stationary iron body and the lower stationary iron body are inserted into the sleeve together.

5. The curling iron of claim 4, wherein the upper stationary iron body comprises at least one guide protrusion.

6. The curling iron of claim 5, wherein the upper movable iron body comprises at least one guide groove corresponding to the at least one guide protrusion of the upper stationary iron body, wherein the at least one guide protrusion can be inserted into the at least one guide groove such that retraction and extension of the upper movable iron body from the upper stationary iron body is guided.

7. The curling iron of claim 4, wherein the first locking switch comprises:

a latch protrusion on a first end, wherein the latch protrusion is configured to be inserted into a slot on the upper movable iron body and lock the upper movable iron body extended from the upper stationary iron body;

a pressing area on a second end, opposite to the first end; and a hinge between the first and the second ends that is configured to allow the first locking switch to pivot thereabout, wherein the hinge provides a constant force on the first end and pivots when an external force is applied on the pressing area on the second end.

8. The curling iron of claim 4, wherein the upper movable iron body further comprises an electrical switch, wherein the electrical switch comes in contact with an electrical terminal of the power cable in the upper stationary iron body when the upper movable iron body is locked extended from the upper stationary iron body.

9. The curling iron of claim 8, wherein the heating member is configured to provide heat when electricity is provided thereto from the power cable when the electrical switch and the electrical terminal of the power cable are in contact.

* * * * *